United States Patent [19]

Ricks, Jr. et al.

[11] Patent Number: 4,863,175

[45] Date of Patent: Sep. 5, 1989

[54] GAME APPARATUS AND METHOD

[76] Inventors: Alfred Ricks, Jr., 405 N. 6th St.; Michael E. Williams, 10119 Hillridge, both of, La Porte, Tex. 77571

[21] Appl. No.: 215,757

[22] Filed: Jul. 6, 1988

[51] Int. Cl.[4] ..... A73B 67/00

[52] U.S. Cl. ..... 273/342; 273/402

[58] Field of Search ..... 273/342, 398, 399, 400, 273/401, 402

[56] References Cited

U.S. PATENT DOCUMENTS

| | | | |
|---|---|---|---|
| 1,616,270 | 2/1927 | Madden | 273/401 |
| 1,636,920 | 7/1927 | Nichols | 273/402 |
| 4,565,375 | 1/1986 | Dresel | 273/401 |
| 4,726,592 | 2/1988 | Callahan | 273/342 |

*Primary Examiner*—William H. Grieb

*Attorney, Agent, or Firm*—Browning, Bushman, Zamecki & Anderson

[57] ABSTRACT

The present invention is directed to a goal assembly and game apparatus and to a method of playing a game therewith. The goal assembly includes a scoring port disposed substantially horizontally and above a hard playing surface. The scoring port is disposed in a substantially horizontal portion of a backboard assembly including an inclined portion, the angles and horizontal portions being joined along a common edge at an abtuse angle, preferably less than about 135°. The object of the game is to score points by tossing a ball through the scoring port, not directly, but only after it has bounced on the playing surface. The additional skill for scoring after multiple bounces is rewarded by multiplying the point value assigned to a scoring ball by the number of bounces. Additional skill is required when a plurality of balls of differing diameters and bounce characteristics are employed. Different balls are assigned different scoring values.

20 Claims, 1 Drawing Sheet

FIG. 1
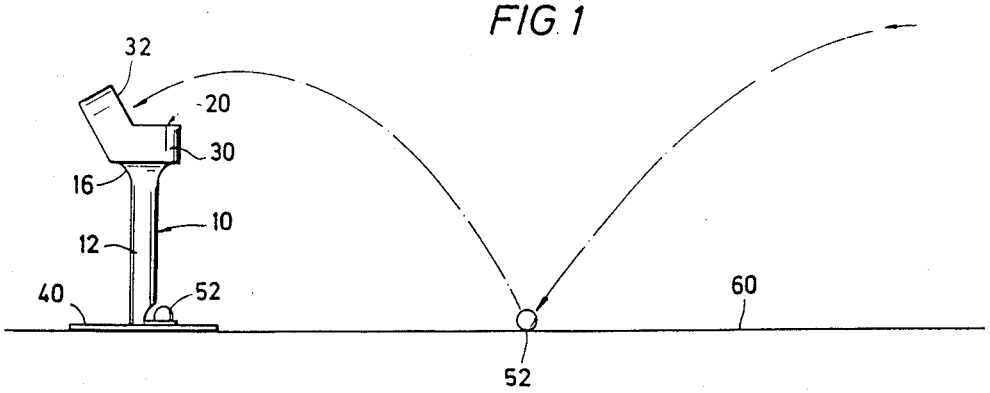
FIG. 3
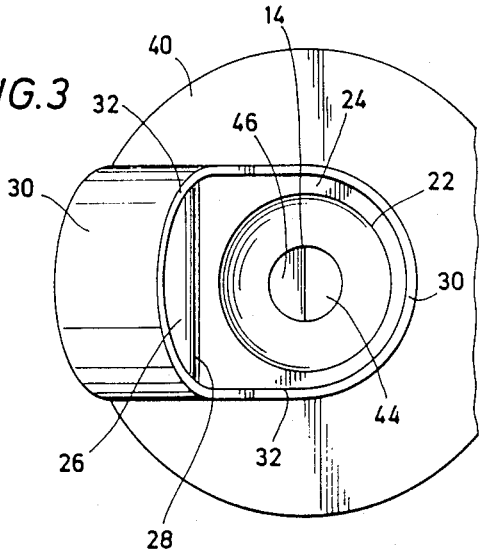
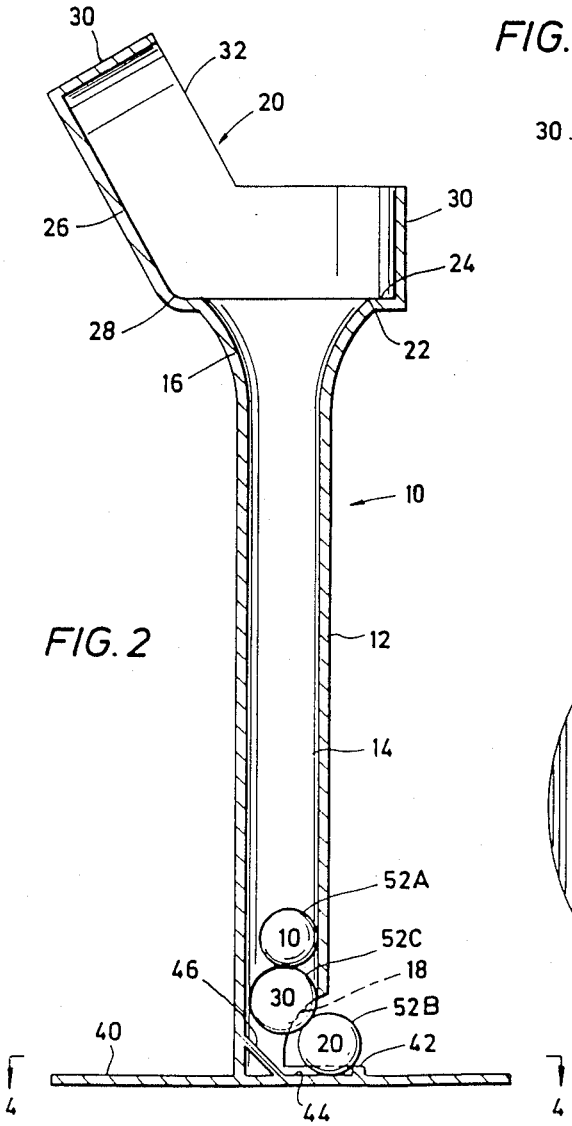
FIG. 2
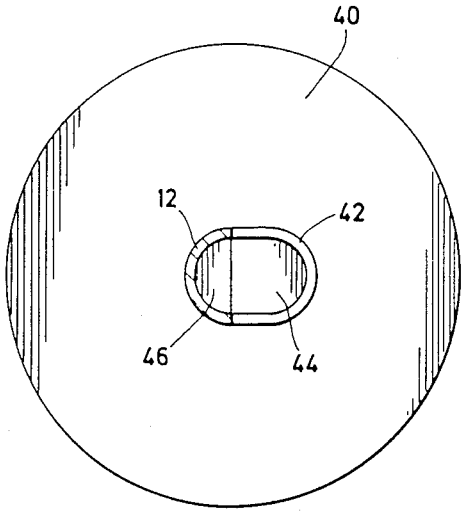
FIG. 4

GAME APPARATUS AND METHOD

BACKGROUND OF THE INVENTION

1. Field of the Invention

The present invention generally relates to a game apparatus and method. The present invention comprises a specifically designed goal assembly for use in playing a game and a method of using the goal assembly including a method for scoring points by bouncing a ball on a hard playing surface toward the goal assembly. The goal assembly of the present invention includes a scoring port in a substantially horizontal portion of a backboard with an inclinded portion disposed at an obtuse angle to the horizontal portion.

2. Description of the Background

Many games exist employing a ball and a goal. Such games include football and basketball which are among the most popular team sports in the United States of America. Other games wherein the object includes directing a ball into or through a goal include golf, pool and rugby. Some such games are team sports, while other such games are individual tests of skill. All of the above games require either large playing surfaces or the investment in expensive playing apparatus.

An object of the present game is to provide a game wherein an individual may play alone or may match skills against other individuals. The game described requires coordination and judgment. The game permits increasing rewards for increasingly difficult plays as skills develop. Another object of the present game is to provide an interesting game employing minimal apparatus to minimize cost, to minimize the playing area required and to permit portability.

SUMMARY OF THE INVENTION

The present invention is directed to game apparatus and a method for playing a game with that apparatus. The game apparatus comprises a goal assembly including a horizontally disposed scoring port and a plurality of balls. The game is played by bouncing a ball on a playing surface above which the scoring port is suspended and downwardly through the scoring port. Points are determined by multiplying a point value assigned to each ball passing through the scoring port by the number of bounces made by the ball before passing through the port.

The goal assembly comprises an angled backboard comprising first and second flat portions joined along a common edge at an obtuse angle, preferably not greater than about 135° and most preferably at about 120°. Preferably, the backboard is symmetrical about a plane of symmetry perpendicular to the common edge and passing through the scoring port. Further, the first and second backboard portions are preferably symmetrical about a plane passing through the common edge without regard to the scoring port.

About the periphery of the backboard on the side defined by the obtuse angle is disposed a guide rail. The guide rail is at least as high as the radius of the largest ball. Preferably the ratio of the height of the rail to the radius of the ball is about 1.1 to about 3.0

Disposed in one of the flat portions of the backboard is a scoring port comprising a hole, preferably circular, of a radius at least as great as that of the largest ball. Preferably the ratio of the radius of the scoring port to the radius of the largest ball is from about 1.1 to about 3.0.

Finally, the goal assembly includes a support attached to the backboard for suspending the backboard above a hard playing surface so that the backboard portion with the scoring port is disposed in a substantially horizontal plane with the remaining backboard portion inclined thereto and directed away from the playing surface. Preferably, the support comprises a tubular riser affixed at one end to the under or reflex side of the backboard about the scoring port. In the presently preferred embodiment, the tubular riser is affixed at its other end to a support base and includes a discharge port for discharging balls into a ball retainer formed by a retainer lip on the base. This configuration assists the players in keeping score by retaining balls passing through the scoring port until retrieved by the players.

The game apparatus comprises a goal assembly together with a plurality of balls, each ball having assigned thereto a specific value. The degree of difficulty of the game may be increased by employing balls of differing diameters and/or differing bounce characteristics. For example, balls with differing diameters may be employed with differing point values assigned for each diameter. Similarly, balls of differing bounce characteristics may be employed with different point values assigned for differing bounce characteristics.

The game is played by positioning the scoring port and the portion of the backboard including the port substantially horizontal to a hard playing surface. Scoring is achieved by tossing a ball toward the scoring port of a goal assembly so positioned. The object is to cause the ball to pass downwardly through the scoring port after bouncing on the playing surface. Points are scored for each toss resulting in a ball passing through the scoring port with the points determined by multiplying the point value assigned to the scoring ball by the number of bounces made by the ball on the playing surface before it passed through the scoring port. Because more coordination is required to pass the ball through the scoring port after multiple bounces, more points are awarded for more bounces.

The goal assembly, combination game apparatus and method of the present game provide an enjoyable outlet to test the skills of one or more players in being able to bounce a ball through the scoring port. Such skills require not only an accurate aim, but an accurate force imparted to the ball together with an accurate prediction of the bounce. The above features of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings, wherein:

FIG. 1 is a side elevation of a goal assembly in accord with the present invention disposed on a hard playing surface and illustrating the flight path of a scoring ball;

FIG. 2 is a side cross-sectional illustration of a goal assembly in accord with the present invention;

FIG. 3 is a top elevation of a goal assembly in accord with the present invention; and FIG. 4 is a horizontal cross-sectional illustration of a goal assembly in accord with the present invention through the plane 4—4 of FIG. 2.

While the invention will be described in connection with the presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENTS

FIGS. 2-4 of the drawings illustrate a presently preferred embodiment of a goal assembly for use in the game of the present invention. FIG. 1 illustrates such a goal assembly disposed on a hard playing surface schematically showing the flight of a successful scoring ball.

A presently preferred goal assembly 10 for use in playing the game of the present invention is illustrated in FIGS. 2-4. The assembly comprises an angled backboard 20 comprising a first or horizontal portion 24 together with a second or inclined portion 26. Horizontal portion 24 and inclined portion 26 are joined along a common edge 28 at an obtuse angle to form the angled backboard 20. In the presently preferred embodiment, the backboard 20 is symmetrical about a plane of symmetry passing through common edge 28 without regard to the presence of scoring port 22. Further, in the presently preferred embodiment, backboard 20 is symmetrical about a plane of symmetry perpendicular to common edge 28 and passing through scoring port 22. Preferably, the obtuse angle is not greater than 135° and most preferably is about 120°.

A guide rail 30 is disposed about the periphery of backboard 20 on the side defined by the obtuse angle. Guide rail 30 is preferably of a height greater than the radius of the largest ball employed in the game. Most preferably, the ratio of the height of the guide rail 30 to the radius of the largest ball is about 1.1 to about 3.0. Although guide rail 30 is solid in the preferred embodiment, guide rail 30 may alternatively be provided by a simple rail or tube suspended above the periphery of the backboard by a plurality of posts. Guide rail 30 forms a guide port 32 through which balls must pass before contacting backboard 20 or passing through scoring port 22.

A scoring port 22 is disposed in the horizontal portion 24 of backboard 20. Scoring port 22 comprises a hole, preferably circular, in horizontal backboard 24 through which a ball 52 may pass. The radius of scoring port 22 must be greater than the radius of the largest ball 52C employed. Preferably, the ratio of the radius of the scoring port 22 to the radius of ball 52 is from about 1.1 to about 3.0. In the presently preferred embodiment, the ratio of the height of guide rail 30 to the radius of scoring port 22 is about 1.3. However, this ratio may be between about 0.3 to about 3.0 as long as the previous ratios to ball radius are satisfied.

Goal assembly 10 includes a support 12 attached to backboard 20 for suspending the backboard above a playing surface 60 so that the scoring port 22 and horizontal backboard 24 are disposed in a substantially horizontal plane with inclined backboard 26 pointed away from surface 60. In the preferred embodiment illustrated in FIG. 2, the support 12 comprises a tubular riser 14 having an internal diameter greater than the diameter of the largest ball 52C. Flared end 16 of tubular riser 14 is affixed to the under or reflex side of backboard 20 about scoring port 22. At its other end, tubular riser 14 is affixed to a support base 40 of appropriate size and configuration for supporting the goal assembly above playing surface 60. In the presently preferred embodiment, support base 40 is merely a large, circular flat base. Alternative supports or support bases might include posts or rods capable of being driven into surface 60 for suspending backboard 20 in the desired position or even clamps or the like for attaching backboard 20 to an existing vertical support.

Optionally, the present invention includes means for retaining and means for discharging balls having passed through scoring ports 22. Such optional features assist the players in keeping track of the scoring. The preferred embodiment illustrated in FIG. 2 includes retainer lip 42 provided in base 40 which, in cooperation with tubular riser 14, defines retainer 44 for retaining balls 52 passing through scoring port 22. Ball discharge port 18 through which players may retrieve scoring balls 52 is illustrated in tubular riser 14. Inclined wedge 46 disposed at the rear of retainer 44 on base 40 aids in directing balls 52 out through discharge port 18.

The goal assembly 10 of the present invention may be constructed of any appropriate material. Very attractive assemblies are produced using plexiglass or other transparent or translucent materials. Alternatively, inexpensive assemblies are constructed using conventional plastics, e.g., blow molded polyethylene or polypropylene.

The game apparatus of the present invention comprises in combination a goal assembly 10 as described together with a plurality of balls 52. Balls 52 may be of differing diameter such as those illustrated in FIG. 2 wherein balls 52A, 52B and 52C are of increasing diameter. A specific scoring value is assigned to each ball. Where balls of differing diameter are employed, differing scoring values may be assigned to each ball. With three balls of increasing diameter, increasing scoring values might be assigned in direct or in inverse relation to the diameter. For example, smallest ball 52A might be assigned the value 10, intermediate ball 52B the value 20 and largest ball 52C the value 30. Similarly, the balls 52 may have differing bounce characteristics with balls of differing bounce characteristics assigned differing scoring values. For example, balls characterized by more bounce might be assigned greater scoring values as previously illustrated with balls of increasing diameter. In a further variation, a plurality of balls characterized by both differing diameters and differing bounce characteristics may be employed. Although it is intended that the present game be played with a set of three to five balls having point values indicated thereon as illustrated by balls 52A, 52B and 52C. Alternatively, values might be indicated by balls of specific color associated with each value. Illustrative of the differing bounce characteristics and diameters would be the differences observed with a plurality of commonly available balls, e.g., golf balls, rubber balls of varying diameters, tennis balls, high bouncer balls and the like.

In the game of the present invention, a goal assembly 10 as described is positioned above a hard playing surface 60 so that scoring port 22 and horizontal backboard 24 are substantially horizontal to the playing surface. Players are positioned on the playing surface facing guide port 32. See FIG. 1. Scoring is achieved by tossing ball 52 toward scoring port 22 of goal assembly 10. The object is to cause the ball 52 to pass downwardly through scoring port 22 in goal assesmbly 10 after bouncing on playing surface 60. No points are scored for directly tossing ball 52 through scoring port 22.

However, players are rewarded for multiple bounces. Players score points for each toss resulting in ball 52 passing through scoring port 22. Points are determined by multiplying a point value assigned to each ball 52 by the number of bounces made by the ball on playing surface 60 before passing through scoring port 22. As described above, the plurality of balls may include balls of differing diameters and/or differing bounce characteristics with each ball assigned a differing point value. Players compete to achieve the highest score. A plurality of players may compete by repetitively and/or consecutively tossing and scoring points. The winner is declared as the player scoring the most points or the first player scoring a predetermined number of points.

The foregoing description of the invention has been directed in primary part to a particular preferred embodiment and method in accordance with the requirements of the patent statutes and for purposes of explanation and illustration. It will be apparent, however, to those skilled in the art that many modifications and changes in the specifically described apparatus and method may be made without departing from the scope and spirit of the invention. For example, support 12 may be in any form capable of supporting scoring port 22 substantially horizontal to playing surface 60. In addition to the tubular riser 14 illustrated, other supports might include posts or rods for driving into playing suface 60, a flexible support, such as a flexible, tubular riser, permitting adjustment above a non-horizontal playing surface or a clamp or other means permitting suspension of backboard 20 from a pre-existing vertical support. Therefore, the invention is not restricted to the particular form of construction or method illustrated and described, but covers all modifications which may fall within the scope of the following claims.

It is Applicants' intention in the following claims to cover such modifications and variations as fall within the true spirit and scope of the invention.

What is claimed is:

1. A goal assembly for a game, comprising:

an angled backboard comprising first and second flat portions joined along a common edge at an obtuse angle to provide a game side about the obtuse angle and a back side;

a guide rail affixed about the edge of said game side;

a scoring port disposed in said first backboard portion comprising a hole in said portion through which balls may pass;

a tubular support for suspending said backboard above a playing surface, said support having first and second ends, said support affixed at said first end to the back side of said backboard about said scoring port and adapted at said second end for supporting said goal assembly above said playing surface so that said game side is disposed away from said playing surface, said support having an interior sufficiently large to accommodate said balls for temporarily retaining said balls; and a discharge port located in said support near said second end.

2. The goal assembly of claim 1 wherein said obtuse angle is not greater than about 135°.

3. The goal assembly of claim 1 wherein said backboard without regard to said scoring port is symmetrical about a plane of symmetry passing through said common edge.

4. The goal assembly of claim 1 wherein said backboard is symmetrical about a plane of symmetry perpendicular to said common edge and passing through said scoring port.

5. The goal assembly of claim 1 wherein said support is flexible permitting said first backboard portion to be disposed substantially horizontally without regard to the contour of said playing surface.

6. The goal assembly of claim 1 together with a plurality of balls for passing through said scoring port wherein said scoring port is circular, the ratio of the radius of said scoring port to the radius of each of said balls being about 1.1–3.0 and the ratio of the height of said rail to the radius of each of said balls being about 1.1–3.0.

7. The goal assembly of claim 1 wherein said support comprises a base for disposition on said playing surface, said base affixed to said second end of said tubular riser, said base including a raised retainer lip for defining a retainer in cooperation with said discharge port.

8. The goal assembly of claim 1 wherein said assembly is comprised of a single piece of molded plastic.

9. The goal assembly of claim 1 wherein said assembly is comprised of transparent or translucent plastic.

10. The goal assembly of claim 1 together with a plurality of balls, each ball having a scoring value assigned thereto.

11. The combination game apparatus of claim 10 wherein said balls have differing diameters.

12. The combination game apparatus of claim 11 wherein said balls of differing diameter are assigned differing scoring values.

13. The combination game apparatus of claim 10 wherein said balls have differing bounce characteristics.

14. The combination game apparatus of claim 13 wherein said balls of differing bounce characteristics are assigned differing scoring values.

15. The goal assembly of claim 1 wherein said first backboard portion is disposed in a substantially horizontal plane with said second backboard portion inclined away from said playing surface.

16. The goal assembly of claim 1 further including a guide means disposed in said support for directing said balls through said discharge port.

17. A method for playing a game, comprising:

tossing balls toward a scoring port in a goal assembly comprising, an angled backboard comprising first and second flat portions joined along a common edge at an obtuse angle to provide a game side about the obtuse angle and a back side;

a guide rail affixed about the edge of said game side;

a scoring port disposed in said first backboard portion comprising a hole in said portion through which balls may pass;

a tubular support for suspending said backboard above a playing surface, said support having first and second ends, said support affixed at said first end to the back side of said backboard about said scoring port and adapted at said second end for supporting said goal assembly above said playing surface so that said game side is disposed away from said playing surface, said support having an interior sufficiently large to accommodate said balls for temporarily retaining said balls; and a discharge port located in said support near said second end;

causing said balls to pass downwardly through said scoring port of said goal assembly after bouncing on said playing surface;

retaining balls passing through said scoring port within said tubular support;

retrieving said balls retained within said tubular support through said discharge port; and scoring points for each toss resulting in a ball passing through said scoring port, said points determined by multiplying a point value assigned to each ball passing through said scoring port by the number of bounces said ball made on said playing surface before passing through said scoring port.

18. The method of claim 17, further comprising:

repeating said tossing and scoring steps with a plurality of balls, each ball having assigned thereto a different point value.

19. The method of claim 17, further comprising:

repeating said tossing and scoring steps with a plurality of balls, each ball having a different size and each size having assigned thereto a different point value.

20. The method of claim 17, further comprising:

repeating said tossing and scoring steps with a plurality of balls, each ball having a different bounce characteristic and each bounce characteristic having assigned thereto a different point value.

* * * * *